US007021301B2

(12) United States Patent
Nagle

(10) Patent No.: US 7,021,301 B2
(45) Date of Patent: Apr. 4, 2006

(54) ARROW REST

(76) Inventor: James L. Nagle, P.O. Box 218, Woodlyn, PA (US) 19094

( * ) Notice: Subject to any disclaimer, the term of this patent is extended or adjusted under 35 U.S.C. 154(b) by 0 days.

(21) Appl. No.: 10/750,616

(22) Filed: Dec. 31, 2003

(65) Prior Publication Data

US 2005/0139201 A1 Jun. 30, 2005

(51) Int. Cl.
*F41B 5/22* (2006.01)

(52) U.S. Cl. ..... 124/44.5
(58) Field of Classification Search ..... 124/24.1, 124/44.5
See application file for complete search history.

(56) References Cited

U.S. PATENT DOCUMENTS

| | | | | |
|---|---|---|---|---|
| 1,526,176 | A * | 2/1925 | O'Connell | 124/24.1 |
| 4,351,311 | A * | 9/1982 | Phares | 124/44.5 |
| 4,372,282 | A * | 2/1983 | Sanders | 124/24.1 |
| 5,042,450 | A * | 8/1991 | Jacobson | 124/44.5 |
| 5,460,153 | A * | 10/1995 | Huntt | 124/44.5 |
| 5,896,849 | A * | 4/1999 | Branthwaite et al. | 124/44.5 |
| 6,557,541 | B1 * | 5/2003 | Pinto, Jr. | 124/44.5 |

* cited by examiner

*Primary Examiner*—John A. Ricci
(74) *Attorney, Agent, or Firm*—Dante C Kohr, Esq.

(57) ABSTRACT

The subject invention relates archery and in particular to an attachment for a bow for retaining the arrow in the shooting position. The arrow rest provides a convenient apparatus for guiding and supporting an arrow on an archery bow. The purpose of this invention is to provide a means for retaining an arrow in position continuously on a bow, as the bow is carried in the drawn position. A rotating ring holds the arrow securely in the drawn position when the bow is tilted or rotated radially which is often the case during hunting.

6 Claims, 5 Drawing Sheets

ARROW REST

FIELD OF THE INVENTION

The subject invention relates archery and in particular to an attachment for a bow for retaining the arrow in the shooting position.

BACKGROUND OF THE INVENTION

The present invention relates generally to archery equipment and, more particularly, to an arrow rest for guiding and supporting an arrow on an archery bow. The purpose of this invention is to provide a means for retaining an arrow in position continuously on a bow, as the bow is carried in the drawn position. Arrow supporting devices or arrow rests are well known to those skilled in the art. The arrow rest provides several important functions for the archer. Initially, the arrow rest supports an arrow prior to a shooting position and guiding the arrow toward the target after it has been released from the bow string. In addition, the arrow rest must cause a minimal amount of frictional resistance to the arrow as it is released from the bow, and minimal damage to the arrow shaft or fletching.

In addition, the arrow rest will ideally support the arrow in a drawn position when the bow is tilted or rotated radially which is often the case during hunting. In this situation the mid-section of the arrow may slip from the arrow rest invariably causing the hunter to miss the target.

Although some prior art devices as disclosed in U.S. Pat. Nos. 2,691,974, 3,244,161, 5,042,450 and 5,896,849 provide radial support of the arrow shaft, such devices have proven to be less than satisfactory. In particular, such devices impart severe frictional resistance to the passage of the arrow unless the fletching is oriented rather precisely to the radial openings in the arrow rest.

Thus, the present invention has been developed to overcome these problems and other shortcomings of the prior art devices.

U.S. Pat. No. 2,691,974 to Nelson teaches an automatic arrow rest that positions itself out of the way after the arrow has left the rest. The Nelson reference discloses a yoke having spaced parallel shafts extended therefrom carried by the lever, and rollers journaled on the shafts of the yoke whereby an arrow in a shooting position extends between the rollers. However, the Nelson reference does not disclose an arrow gripping element which comprises a cylindrical ring made of a resilient, high friction material which rotates from a perpendicular position to grip the arrow as the bow is drawn.

U.S. Pat. No. 3,244,161 to Jenson teaches a spring bias ring arrow rest.

U.S. Pat. No. 5,042,450 teaches a spring arrow support that allows the arrow and fletches to clear the circular guide.

U.S. Pat. No. 5,896,849 to Branthwaite teaches an arrow rest which provides an inverted coil brush comprising a disc shaped structure having a plurality of radially disposed, inwardly projecting bristles forming a central opening wherein the arrow shaft is radially supported.

SUMMARY OF THE INVENTION

The main object of the invention is to provide an arrow rest comprising a bracket adapted to be mounted on a bow with one end extended in line with the draw of the bow, an arm pivotally mounted in the extended end of the bracket, a ring positioned perpendicularly to the bow rotatably mounted on said arm, means for mounting the bracket on a bow with the ring positioned whereby an arrow in the shooting position on one side of the bow extends through the ring, and means to rotate the ring to swing to a position disengaging the ring from the arrow.

Another object of the invention is to provide the arrow rest wherein the ring is made of a resilient, high friction material.

Another object of the invention is to provide the arrow rest wherein the ring is of a generally elliptical shape and positioned at an approximately 45 degree angle when the bow is in the non-drawn position.

Yet another object of the invention is an arrow rest comprising means for supporting an arrow in a drawn position relative to said bow member, said supporting means including a generally circular shaped ring defining a central opening wherein said arrow is supported in said drawn position; and means for removably attaching said supporting means to said bow such that said bow is functional in a conventional manner with said arrow rest removed.

Another object of the subject invention is to provide an arrow rest comprising means for supporting an arrow in a drawn position relative to said bow member, said supporting means including a generally circular shaped ring defining a central opening wherein said arrow is supported in said drawn position; and means for removably attaching said supporting means to said bow such that said bow is functional in a conventional manner with said arrow rest removed.

It is also an object of the present invention to include a mounting bracket adapted to position the ring in a plane perpendicular to the plane defined by the bow and bow string.

It is another object of the present invention whereby said attaching means can be installed on said bow without permanent modification thereof.

These together with other objects of the invention, along with the various features of novelty which characterize the invention, are pointed out with particularity in the claims annexed to and forming a part of this disclosure. For a better understanding of the invention, its advantages and the specific objects attained by its uses, reference should be had to the accompanying drawings and descriptive matter in which there is illustrated preferred embodiments of the invention.

DETAILED DESCRIPTION OF THE INVENTION

Figure 1:
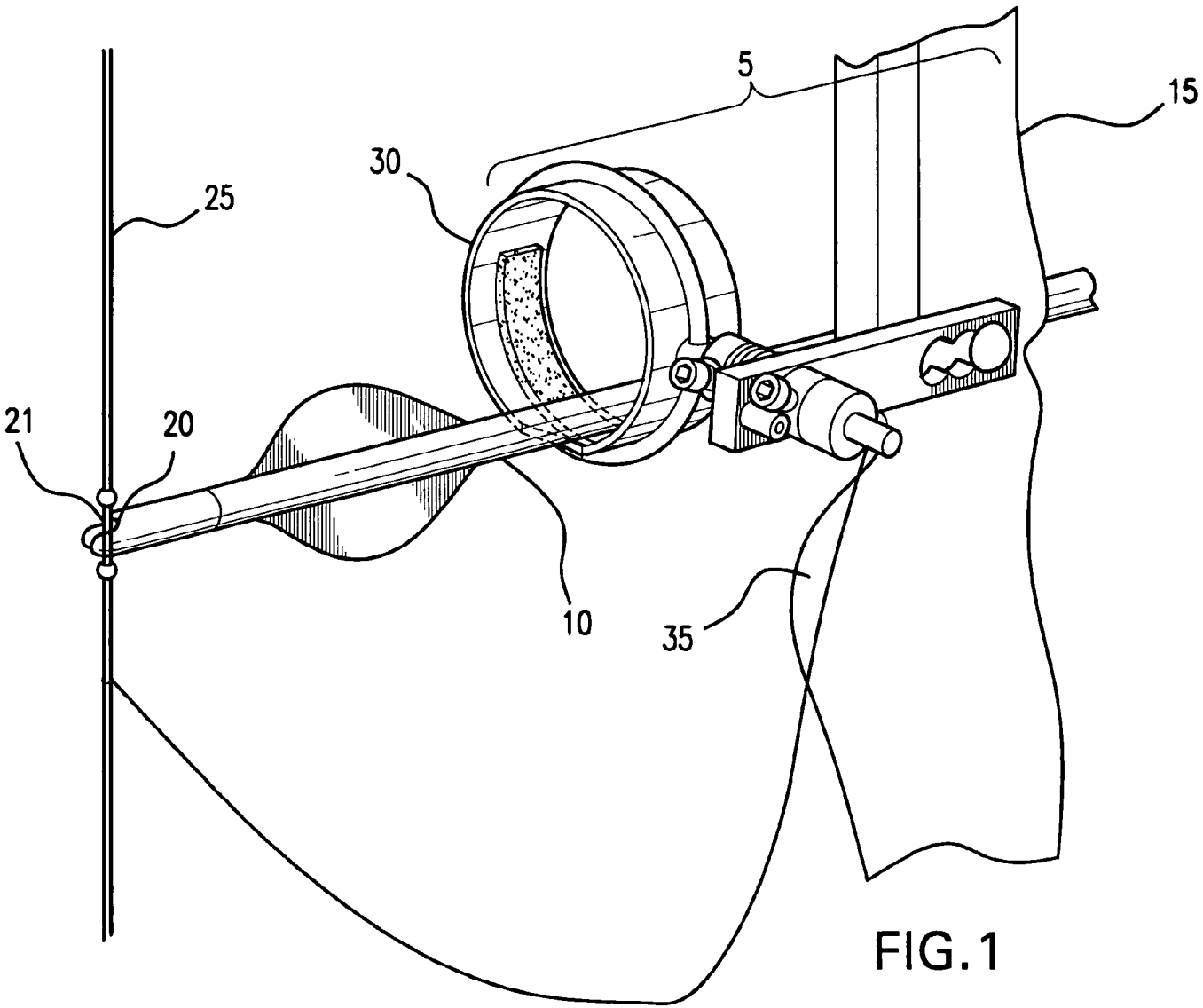
FIG. 1 shows a perspective view of the invention in the open position.

Referring first to FIG. 1, which shows the arrow rest which is generally indicated at 5. Arrow rest 5 is shown installed in its functional position on an archery bow. Arrow 10 is shown in the a pre-draw position on bow 15. By pre-draw position it is meant that nock 20 of arrow 10 is received on the nocking point 21 of bow string 25 and arrow 10 is inserted through ring 30 of arrow rest 5 above handle 35 of bow 15. From the position shown in FIG. 1 no tension is applied to the bow and arrow 10 rests in the lower portion of ring 30 ready to be drawn.

Figure 2:
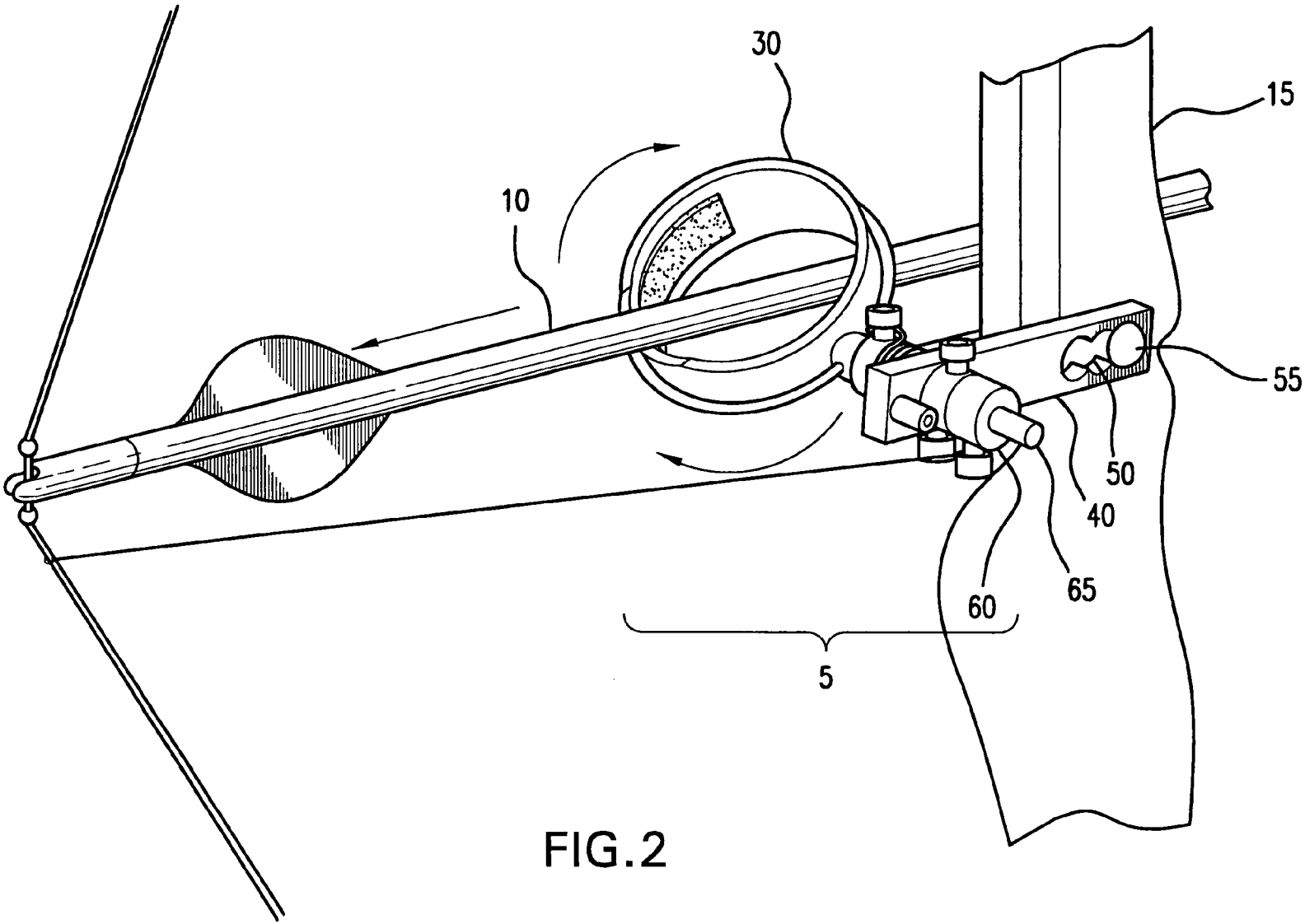
FIG. 2 shows a perspective view of the invention in the resting position.

FIG. 2 shows arrow 10 and bow 15 in the fully drawn position and ready to be released. FIG. 2 illustrates how ring 30 of arrow rest 5 rotatably moves whereby it secures arrow 10 so long as bow 15 is maintained in the drawn position.

Figure 3:
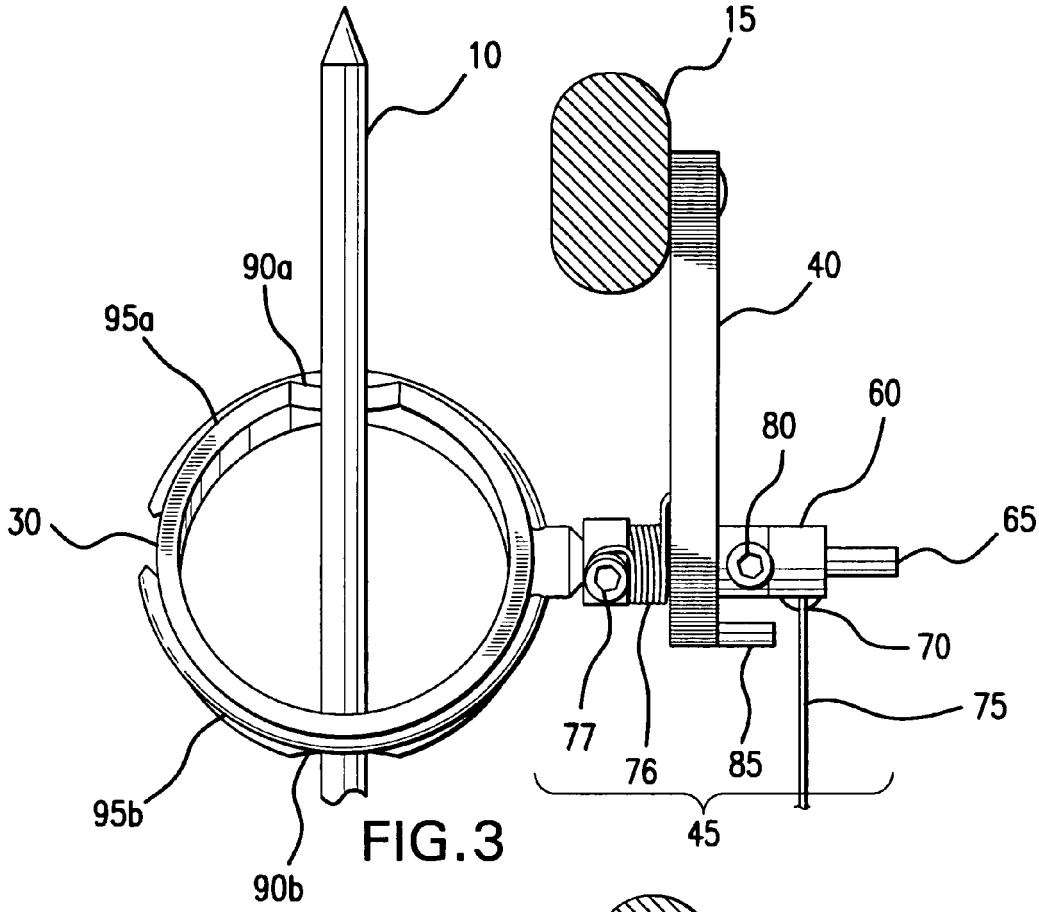
FIG. 3 shows a top plan view with the arrow in the resting position.

Referring now to FIG. 3 the arrow rest includes a bracket 40 adapted to be mounted on bow 15 with one end extended in line with the draw of bow 15, an arm 45 pivotally mounted in the extended end of bracket 40, a ring 30 positioned perpendicularly to bow 15 which is rotatably mounted on said arm 45, means for mounting bracket 40 on bow 15 with ring 30 positioned whereby arrow 10 in the shooting position on one side of the bow extends through ring 30, and means to rotate ring 30 to swing to a position disengaging ring 30 from the arrow.

Bracket 40 is shown in detail in FIG. 2 whereby one end of bracket 40 with opening 50 therein permits bracket 40 to be fixedly attached to bow 15 with screw 55 or similar device. The opposite end of bracket 40 has opening 50 positioned to receive casing 60 which holds shaft 65.

Figure 4:
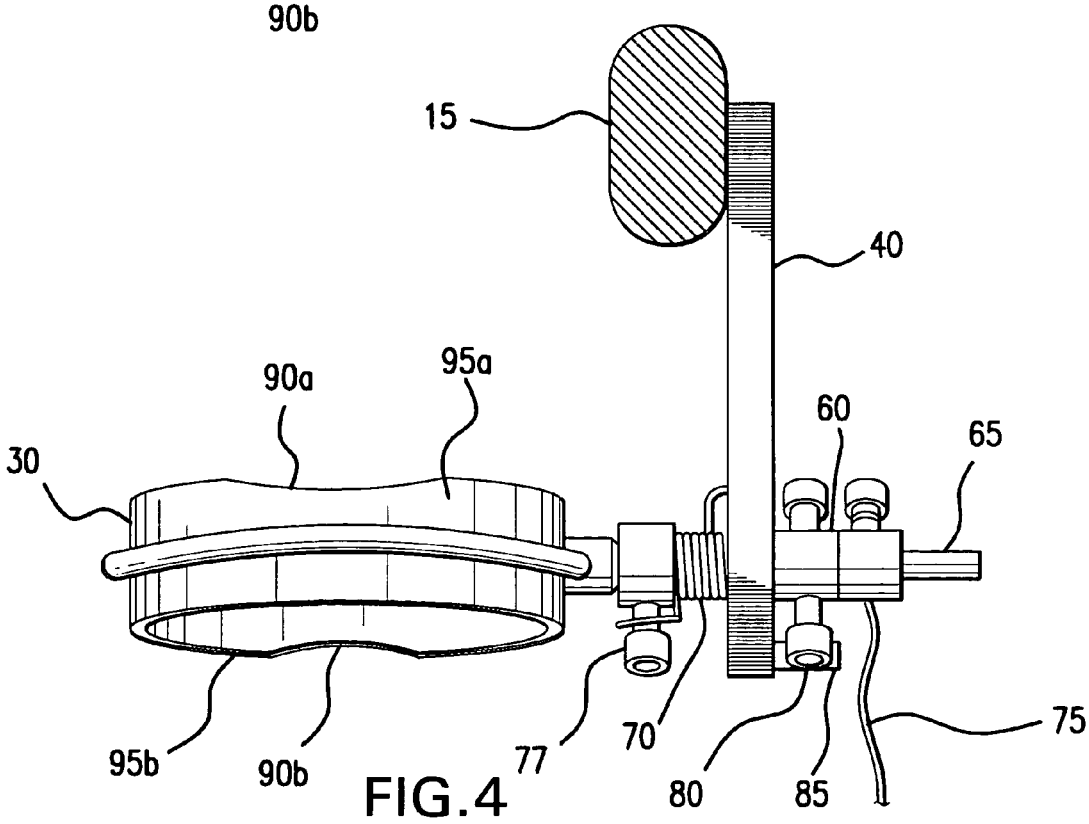
FIG. 4 shows a top plan view after the arrow has been released.

Casing 60 and shaft 65 are illustrated in FIGS. 3 and 4. Set screw 70 is set into shaft 65 from which cable 75 extends to bow string 30 (not shown). Shaft 65 is urged to rotate around its longitudinal axis by spring 76 one end of which is attached to shaft 65 by third screw 77, and the other end is attached to bracket 40, to which it is attached by a second screw 56. The shaft is provided with a pin 80 which extends perpendicularly out from shaft 65 and is positioned to engage hub 85 which is set in bracket 40 to limit the turning movement of shaft 65 when bow 15 is in the non-drawn position.

Ring 30 is fixedly attached to the opposite end of shaft 65 and is of a generally circular shape. Notches 90*a*,90*b* are formed in the ring on opposite edges 95*a*,95*b* of the outer surface of the ring so as to engage arrow 10 as the bow is drawn. Ring 30 is made of a high friction plastic or similar material to ensure a firm grip on arrow 10 when bow 15 is brought to a fully drawn position.

Figure 5:
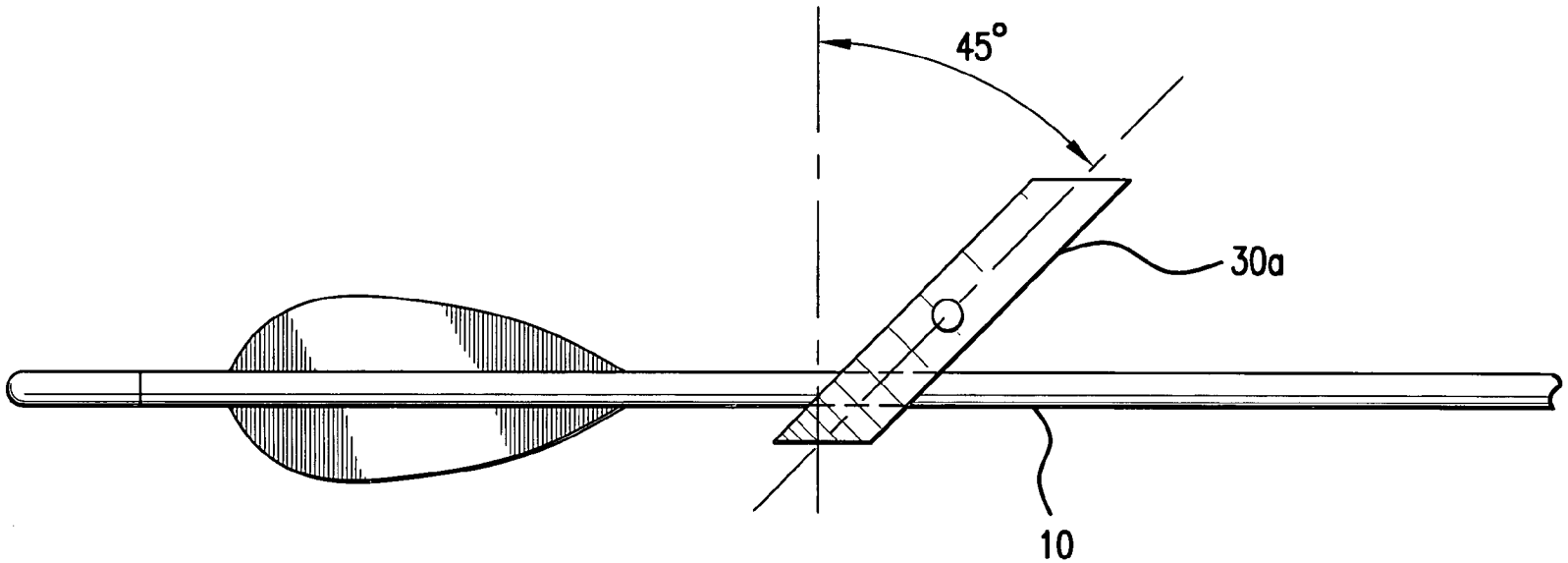
FIG. 5 shows a side view of the elliptical ring in the bow's undrawn position.
Figure 6:
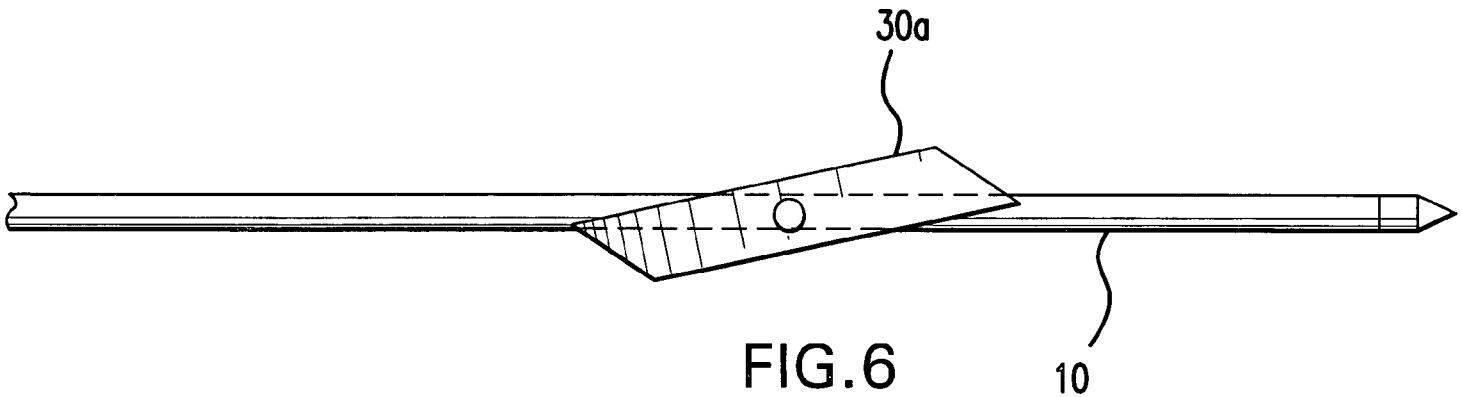
FIG. 6 shows a side view of the elliptical ring in the bow's drawn position.

Ring 30 can alternatively be provided in an elliptical shape which would allow for lesser movement of elliptical ring 30*a* from the drawn to released, or undrawn, positions. As shown in FIG. 5 elliptical ring 30*a* would be able to be positioned at an angle of approximately 45 degrees in the released or undrawn position and when bow 15 is drawn elliptical ring 30*a* would securely hold arrow 10 as shown in FIG. 6.

Figure 7:
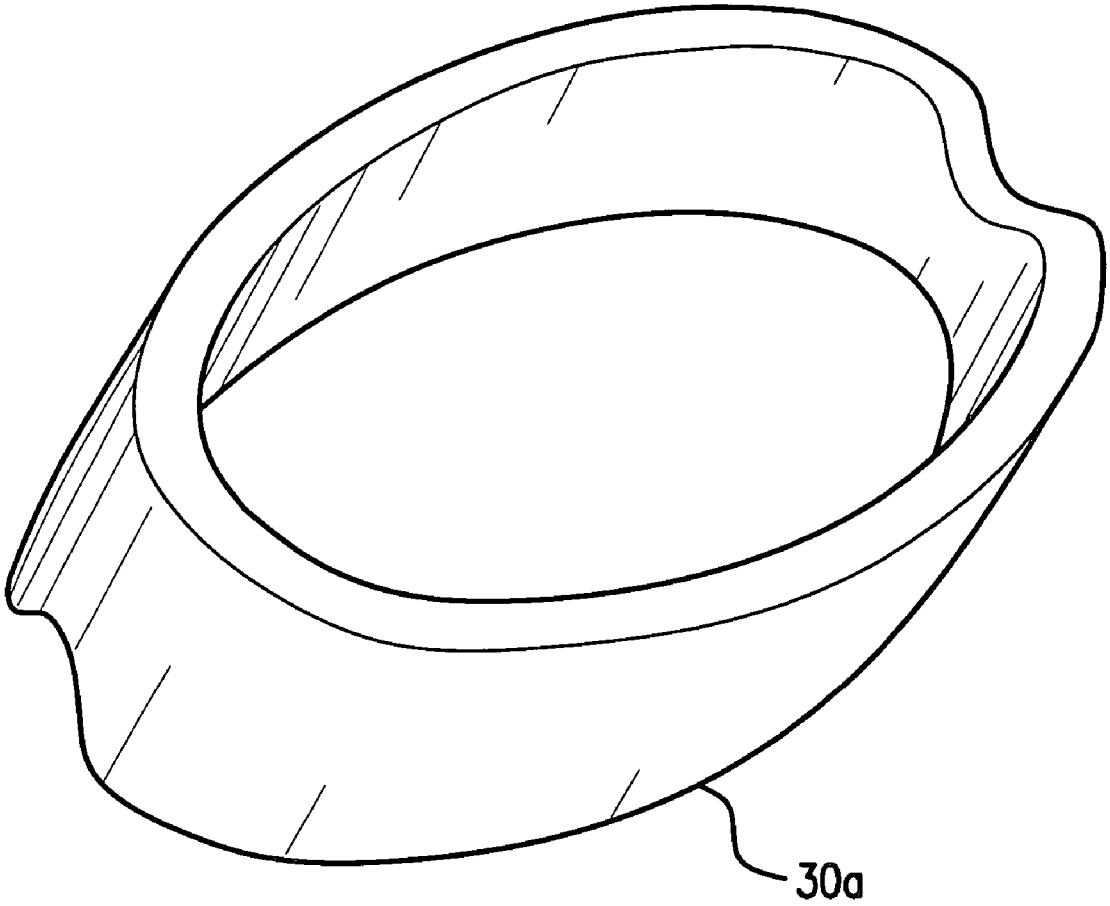
FIG. 7 shows a perspective view of the elliptical ring of the invention.

The elliptical ring 30*a* as shown in FIG. 7. Notches are formed in the elliptical ring 30*a* on opposite edges of the outer surface of the elliptical ring 30*a* so as to engage arrow as the bow is drawn.

Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Although this invention has been disclosed in the context of certain preferred embodiments and examples, it therefore will be understood by those skilled in the aft that the present invention extends beyond the specifically disclosed embodiments and/or uses of the invention and obvious modifications and equivalents thereof. Thus, it is intended that the scope of the present invention herein disclosed should not be limited by the particular disclosed embodiments described above, but should be determined only be a fair reading of the claims that follow.

What is claimed is:

1. An arrow rest comprising a bracket adapted to be mounted on a bow with one end extended in line with the draw of the bow, an arm pivotally mounted in the extended end of the bracket, a ring positioned perpendicularly to the bow rotatably mounted on said arm, means for mounting the bracket on a bow with the ring positioned whereby an arrow in the shooting position on one side of the bow extends through the ring, and means to rotate the ring to swing to a position disengaging the ring from the arrow.

2. An arrow rest of claim 1 wherein the ring is made of a resilient, high friction material.

3. An arrow rest of claim 2 wherein the ring is of a generally elliptical shape and positioned at an approximately 45 degree angle when the bow is in the non-drawn position.

4. An arrowrest comprising a bracket with one end adapted to be attached to a bow, and the other end extending out in line with the draw of the bow, a shaft passing perpendicularly through the opposite end of the bracket, a ring fixedly mounted on an end of the shaft, a resilient means around the shaft urging the shaft and ring to such a position that the ring is parallel to the bow, a resistant means for urging the ring to a position whereby an arrow is securely held by the ring when the bow is drawn to a shooting position.

5. An arrow rest of claim 4 wherein the ring is made of a resilient, high friction material.

6. An arrow rest of claim 5 wherein the ring is of a generally elliptical shape and positioned at an approximately 45 degree angle when the bow is in the non-drawn position.

* * * * *